US008150277B2

(12) United States Patent
Takiguchi

(10) Patent No.: US 8,150,277 B2
(45) Date of Patent: Apr. 3, 2012

(54) IMAGE FORMING APPARATUS WITH SYSTEM FOR REPLENISHING A PLURALITY OF TONER CARTRIDGES

(75) Inventor: Toshiki Takiguchi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 429 days.

(21) Appl. No.: 12/395,659

(22) Filed: Feb. 28, 2009

(65) Prior Publication Data

US 2009/0220253 A1 Sep. 3, 2009

(30) Foreign Application Priority Data

Mar. 3, 2008 (JP) ..... 2008-052672

(51) Int. Cl.
*G03G 15/06* (2006.01)
*G03G 15/08* (2006.01)
*G03G 21/00* (2006.01)

(52) U.S. Cl. ..... 399/27; 399/28; 399/61; 399/258

(58) Field of Classification Search ..... 399/27, 399/28, 29, 30, 61, 258, 260
See application file for complete search history.

(56) References Cited

U.S. PATENT DOCUMENTS 5,045,884 A 9/1991 Ohira et al.
5,652,947 A * 7/1997 Izumizaki ..... 399/58
5,826,134 A * 10/1998 Hino et al. ..... 399/27
6,347,199 B1 2/2002 Morihara
7,110,707 B2 * 9/2006 Nishitani ..... 399/258
7,206,528 B2 * 4/2007 Matsunai ..... 399/43
7,248,805 B2 * 7/2007 Hirota et al. ..... 399/27
7,248,825 B2 * 7/2007 Nishitani et al. ..... 399/258
7,522,851 B2 * 4/2009 Koyama et al. ..... 399/27
7,536,122 B2 * 5/2009 Ohkawa et al. ..... 399/27
7,664,435 B2 * 2/2010 Nose ..... 399/227
7,668,470 B2 * 2/2010 Tsuji et al. ..... 399/27
7,738,816 B2 * 6/2010 Sakita et al. ..... 399/258
2004/0052538 A1 3/2004 Yugeta et al.

FOREIGN PATENT DOCUMENTS

JP 02-201393 8/1990
JP 2-234177 9/1990
JP 11295975 A * 10/1999
JP 2002-148926 A 5/2002
JP 2004-109367 A 4/2004
JP 2004347794 A * 12/2004
JP 2005-062649 A 3/2005
JP 2005-84072 3/2005

* cited by examiner

*Primary Examiner* — David Gray
*Assistant Examiner* — Fred L Braun
(74) *Attorney, Agent, or Firm* — Renner, Otto, Boisselle & Sklar, LLP

(57) ABSTRACT

There is provided an image forming apparatus that is capable of reducing work burdens imposed on a user in terms of toner cartridge replacement. When a cartridge detection sensor detects that at least one of toner cartridges is emptied, a specified amount of toner is forcibly supplied from another toner cartridge than the toner cartridge subjected to detection to an intermediate hopper. After that, the amount of the toner within the another toner cartridge is detected. When an empty toner cartridge is newly detected, a request for replacement is issued as to both of the newly detected empty toner cartridge and the previously detected empty toner cartridge.

5 Claims, 5 Drawing Sheets

IMAGE FORMING APPARATUS WITH SYSTEM FOR REPLENISHING A PLURALITY OF TONER CARTRIDGES

CROSS-REFERENCE TO RELATED APPLICATION

This application claims priority to Japanese Patent Application No. 2008-052672, which was filed on Mar. 3, 2008, the contents of which are incorporated herein by reference in its entirety.

BACKGROUND OF THE INVENTION

1. Field of the Invention

The present invention relates to an image forming apparatus having a plurality of toner cartridges for containing toners for replenishment, an intermediate hopper to which the toner contained in the toner cartridge is to be supplied, and a developing device to which the toner supplied to the intermediate hopper is to be supplied.

2. Description of the Related Art

In general, an image forming apparatus that utilizes an electrophotography technique is composed of a photoreceptor which is a rotating image carrier, and a charging section, an exposure section, a developing section, a transfer section, a fixing section, a cleaning section, and a de-electrifying section that are arranged around the photoreceptor. The charging section applies electric charge uniformly over the surface of the photoreceptor. The exposure section exposes the surface of the photoreceptor in a charged state to light in accordance with image information to thereby form an electrostatic latent image. The developing section agitates a toner so that it can be electrically charged by friction, and then causes the frictionally-charged toner to adhere to the electrostatic latent image formed on the surface of the photoreceptor to thereby form a toner image. The transfer section transfers the toner image onto a recording medium by applying, to the recording medium, electric charge of a polarity reverse to the polarity of the charge borne on the toner. The fixing section fixes the transferred toner image onto the recording medium by means of application of heat, pressurization, or otherwise. The cleaning section collects toner portions that remain on the surface of the photoreceptor because of not having been transferred onto the recording medium. The de-electrifying section de-electrifies the photoreceptor following the completion of the transfer of the toner image. By virtue of the image forming apparatus employing the electrophotography technique thereby constructed, a desired image can be formed on the recording medium.

In such an image forming apparatus, since a toner for use in the developing section thereof to perform development is a consumable product, there is provided a toner replenishment section for effecting the replenishment of a supply of a toner on a developer housing which is a container for containing a toner to be provided for the developing section. In general, the toner replenishment section acts to replenish the developer housing with a toner contained in a toner cartridge designed so as to be attachable to and detachable from the image forming apparatus by way of an intermediate hopper.

In this construction, upon the toner contained in the toner cartridge running out due to toner replenishment for the developer housing, the operation of the image forming apparatus is brought to a halt. Then, the toner cartridge empty of the toner is replaced with a new toner cartridge to replenish the developer housing with a toner. By doing so, the image forming operation can be carried out once again.

In recent years, there have been developed electrophotographic image forming apparatuses such as copying machines and printers intended for general users that are used very frequently with consumption of a large amount of a toner. In such an apparatus, a plurality of toner cartridges can be mounted. Therefore, even if one of the toner cartridges is emptied, toner replenishment can be effected with another toner cartridge, and the toner cartridge empty of the toner can be replaced with the new one in the course of toner replenishment effected with use of another toner cartridge.

In a case of a color image forming apparatus for printing full-color images, toners of four colors: cyan; magenta; yellow; and black are used. In this case, even if only one toner cartridge is mounted for each of the colors on an individual basis, four toner cartridges will be necessary after all. It is thus difficult to mount a plurality of toner cartridges per color.

In regard to the replacement of the toner cartridge, the amount of a toner remaining in the toner cartridge or the amount of a toner remaining in the intermediate hopper is detected by a sensor. Depending upon the result of the detection, a notice is given to make a user aware of the necessity of toner cartridge replacement.

In the image forming apparatus disclosed in Japanese Unexamined Patent Publication JP-A 2005-84072, when a remaining amount detection sensor disposed within a toner hopper detects that the amount of toner accumulation within the toner hopper has been decreased to a specified level or below, then a toner bottle is rotated to effect toner replenishment for the toner hopper. When the result of the detection provided by the remaining amount detection sensor is found to stay the same (the amount of accumulation is found to be less than or equal to the specified level) even after the number of rotation of the toner bottle reached a specified rotational number or even after a lapse of specified rotational time, then the emptiness of the toner bottle is recognized and a request for toner bottle replacement is indicated.

In a case where a plurality of toner cartridges are provided, detection of a toner remaining amount is carried out for each of the toner cartridges on an individual basis. In this case, every time any one of the toner cartridges is emptied (the remaining toner amount has been decreased to a specified level or below), the operation of the apparatus is brought to a halt and a message of a request for toner cartridge replacement is indicated.

When it is detected that a toner cartridge for a black toner is emptied, the operation of the apparatus is brought to a halt and a message of a request for replacement of the black toner cartridge is indicated.

At that point of time, even if the remaining amount of a toner in a toner cartridge for a yellow toner is getting so small, there is given no indication of a message of request for replacement of the yellow toner cartridge. Therefore, the user replaces only the black toner cartridge with a new one in response to the request for replacement. If the replacement of the yellow toner cartridge becomes necessary immediately after the replacement of the black toner cartridge, the operation of the apparatus has to be brought to a halt once again to carry out a replacement procedure. This gives rise to a problem that the user is required to carry out toner replacement procedures many a time in a short period of time.

SUMMARY OF THE INVENTION

An object of the invention is to provide an image forming apparatus that is capable of reducing work burdens imposed on a user in terms of toner cartridge replacement.

The invention provides an image forming apparatus comprising:

a plurality of toner cartridges for containing toners for replenishment;

an intermediate hopper to which the toner contained in the toner cartridge is to be supplied;

a developing device to which the toner supplied to the intermediate hopper is to be supplied;

toner amount detection sections for detecting amounts of the toners contained in the plurality of toner cartridges, respectively; and a control section for exercising control in such a manner that, when at least one of detected amounts of the toners contained in the plurality of toner cartridges by the toner amount detection sections is less than a specified amount, then a specified amount of toner is supplied from another toner cartridge than the relevant toner cartridge to the intermediate hopper.

According to the invention, the image forming apparatus comprises the toner amount detection sections that detect the amounts of the toners within a plurality of the toner cartridges, respectively. When at least one of detected amounts of the toners contained in the plurality of toner cartridges by the toner amount detection sections is less than a specified amount, then the control section exercises control in a manner permitting the supply of a specified amount of the toner from another toner cartridge than the relevant toner cartridge to the intermediate hopper.

That is, under the control of the control section, in the toner cartridge in which the toner amount has not yet been reduced to a level where replacement is required, a specified amount of the toner is forcibly supplied to the intermediate hopper to reduce the toner amount thereof, whereby making it possible to equalize contained amounts among a plurality of the toner cartridges and thereby allow a plurality of the toner cartridges to be replaced with the new ones around the same time.

In this way, there arises a fair chance that the user is able to replace a plurality of the toner cartridges en masse in a single replacement procedure. Accordingly, the work burdens imposed on the user can be reduced.

Moreover, the invention provides an image forming apparatus comprising:

a plurality of toner cartridges for containing toners for replenishment on a color-by-color basis;

a plurality of intermediate hoppers to which the respective toners contained in the plurality of toner cartridges are to be supplied;

a plurality of developing devices to which the respective toners supplied to the respective intermediate hoppers are to be supplied;

toner amount detection sections for detecting amounts of the toners contained in the plurality of the toner cartridges, respectively; and a control section for exercising control in such a manner that, when at least one of detected amounts of the toners contained in the plurality of toner cartridges by the toner amount detection sections is less than a specified amount, then a specified amount of toner is supplied from another toner cartridge than the relevant toner cartridge to the intermediate hopper.

According to the invention, the image forming apparatus comprises the toner amount detection sections that detect the amounts of the toners within a plurality of the toner cartridges for containing the toners on a color-by-color basis, respectively. When at least one of detected amounts of the toners contained in the plurality of toner cartridges by the toner amount detection sections is less than a specified amount, then the control section exercises control in a manner permitting the supply of a specified amount of the toner from another toner cartridge than the relevant toner cartridge to the intermediate hopper.

That is, under the control of the control section, in the toner cartridge in which the toner amount has not yet been reduced to a level where replacement is required, a specified amount of the toner is forcibly supplied to the intermediate hopper to reduce the toner amount thereof, whereby making it possible to equalize contained amounts among the toner cartridges for a plurality of colors and thereby allow a plurality of the toner cartridges to be replaced with the new ones around the same time.

In this way, there arises a fair chance that the user is able to replace the toner cartridges for a plurality of colors en masse in a single replacement procedure. Accordingly, the work burdens imposed on the user can be reduced.

Moreover, in the invention, it is preferable that the image forming apparatus further comprises a display section for indicating a request for replacement of the toner cartridge, the toner amount detection section detects the amount of the toner within the another toner cartridge after the specified amount of the toner is supplied from the another toner cartridge to the intermediate hopper, and the control section effects control of the display section in a manner so as to indicate a request for replacement with respect to every one of the toner cartridges in which the amount of the toner contained therein is found to be less than the specified amount through the detection made by the toner amount detection section.

According to the invention, after the specified amount of the toner is supplied from the another toner cartridge to the intermediate hopper, the toner amount detection section detects the amount of the toner within the another toner cartridge once again. At this time, the control section effects control of the display section in a manner so as to indicate a request for replacement with respect to every one of the toner cartridges in which the amount of the toner contained therein is found to be less than the specified amount through the detection made by the toner amount detection section.

In the presence of a plurality of toner cartridges that differ little from one another in the amount of the contained toner, even if there is a toner cartridge in which the toner amount has not yet been reduced to a level where replacement is required, when a specified amount of the toner contained therein is forcibly supplied to the intermediate hopper to reduce the toner amount, its replacement may be necessary.

After the amount of the toner is forcibly reduced, toner amount detection is conducted once again. In this way, a toner cartridge which needs replacement can be newly detected, and a request for replacement of all of the toner cartridges in need of replacement can be indicated.

It is thus possible for the user to replace a plurality of the toner cartridges en masse in a single replacement procedure, wherefore the work burdens imposed on the user can be reduced.

Moreover, in the invention, it is preferable that the image forming apparatus further comprises a hopper toner amount detection section for detecting the amount of the toner within the intermediate hopper, and the control section exercises control in such a manner that the supply of the toner from the another toner cartridge to the intermediate hopper is continued until the hopper toner amount detection section detects that the amount of the toner within the intermediate hopper is greater than or equal to a specified amount.

According to the invention, the control section exercises control in such a manner that the supply of the toner from the another toner cartridge to the intermediate hopper is continued until the hopper toner amount detection section detects that the amount of the toner within the intermediate hopper is greater than or equal to the specified amount.

In this way, the amount of the toner that is forcibly supplied from the another toner cartridge to the intermediate hopper can be so controlled as to be an adequate amount.

Moreover, in the invention, it is preferable that the hopper toner amount detection section detects whether the intermediate hopper is filled to capacity with the toner or not, and the control section exercises control in such a manner that the supply of the toner from the another toner cartridge to the intermediate hopper is continued until the hopper toner amount detection section detects that the intermediate hopper is filled to capacity with the toner.

According to the invention, the control section exercises control in such a manner that the supply of the toner from the another toner cartridge to the intermediate hopper is continued until the hopper toner amount detection section detects that the intermediate hopper is filled to capacity with the toner.

In this way, the amount of the toner that is forcibly supplied from the another toner cartridge to the intermediate hopper can be raised to a maximum.

Moreover, in the invention, it is preferable that, in a course of image forming operation, even if the toner amount detection section detects that at least one of a plurality of the toner cartridges is in a state where the amount of the toner contained therein is less than a specified amount, so long as it can be detected by the toner amount detection section that at least one of a plurality of the toner cartridges is in a state where the amount of the toner contained therein is greater than or equal to the specified amount, the control section continues the image forming operation.

According to the invention, in the course of image forming operation, even if the toner amount detection section detects that at least one of a plurality of the toner cartridges is in a state where the amount of the toner contained therein is less than the specified amount, so long as it can be detected by the toner amount detection section that at least one of a plurality of the toner cartridges is in a state where the amount of the toner contained therein is greater than or equal to the specified amount, the image forming operation will be continued.

This makes it possible to reduce the number of times that the operation is brought to a halt during image formation.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
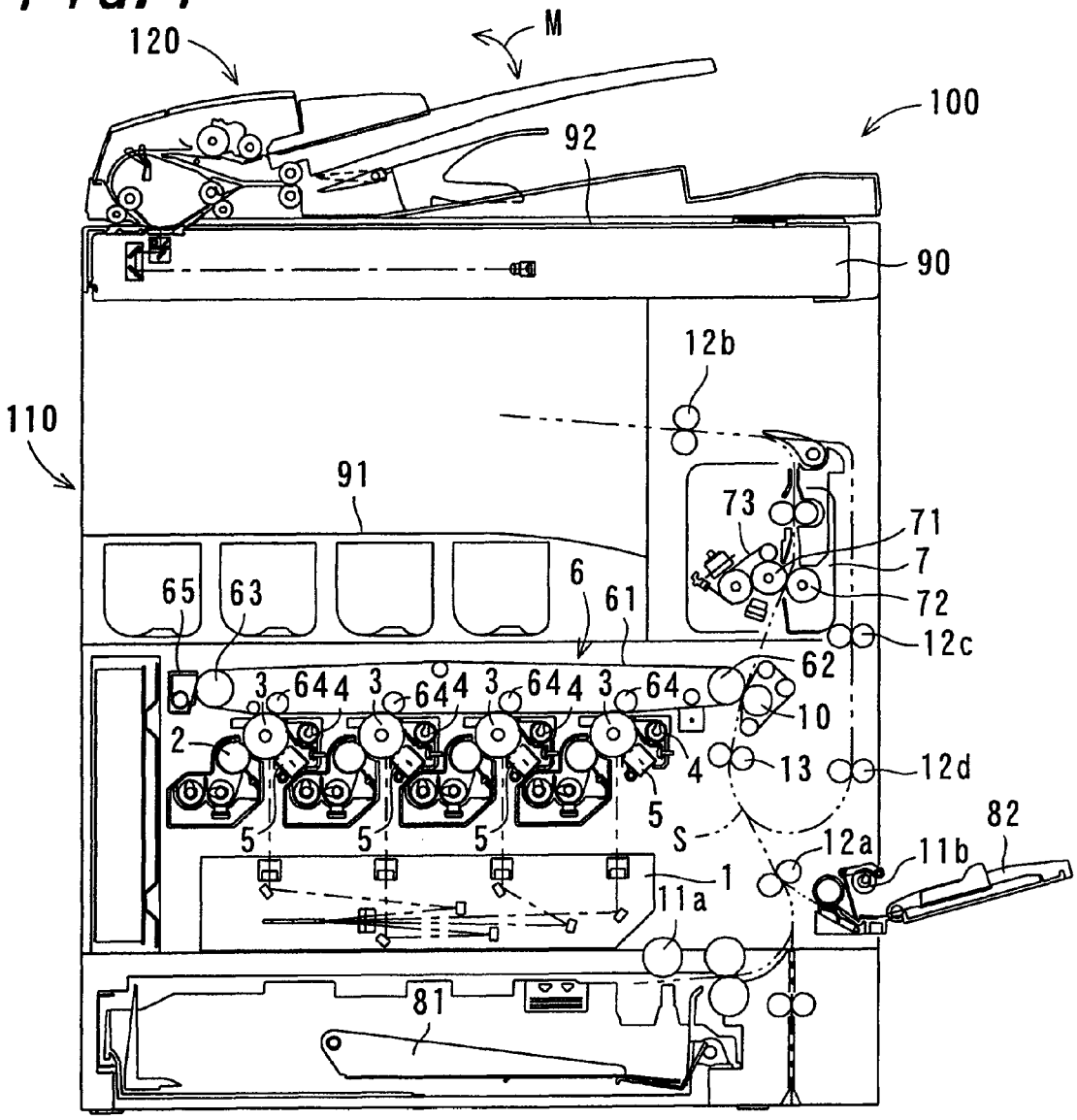
FIG. 1 is a diagram showing the structure of an image forming apparatus in accordance with one embodiment of the invention.

Now referring to the drawings, preferred embodiments of the invention will be described in detail.

FIG. 1 is a diagram showing the structure of an image forming apparatus 100 in accordance with one embodiment of the invention. The image forming apparatus 100 is designed to form multi-color or one-color images on a predetermined recording paper sheet in accordance with externally transmitted image data. The image forming apparatus 100 comprises an apparatus main body 110 and an automatic document reading device 120.

The apparatus main body 110 comprises an exposure unit 1, a developing device 2, a photoreceptor drum 3, a cleaner unit 4, a charging device 5, an intermediate transfer belt unit 6, a fixing unit 7, a paper feeding cassette 81, a catch tray 91, and so forth.

On the top part of the apparatus main body 110 is disposed a document platen 92 made of light-transmitting glass on which a document is placed. On the document platen 92 is emplaced the automatic document reading device 120. The automatic document reading device 120 automatically conveys a document onto a document reading region lying on the document platen 92. Moreover, since the automatic document reading device 120 is so designed as to be freely turnable in a direction indicated by an arrow M, it follows that a user is able to place a document with his/her hands by leaving the top of the document platen 92 open.

Pieces of image data to be processed in the image forming apparatus 100 correspond to color images formed by using black (K) color, cyan (C) color, magenta (M) color, and yellow (Y) color, respectively. In order to form four types of toner images of different colors on an individual basis, the developing device 2, the photoreceptor drum 3, the charging device 5, and the cleaner unit 4 are each correspondingly four in number to deal with black, cyan, magenta, and yellow, respectively. In this way, four units of image stations are made up.

The charging device 5 serves as a charging section for uniformly charging the surface of the photoreceptor drum 3 to a predetermined potential. Instead of a charger-type charging device as shown in FIG. 1, a charging device of contact roller type or a charging device of contact brush type may be used for the charging device 5.

The exposure unit 1 is built as a laser scanning unit (LSU) having a laser emitting section, a reflection mirror, and so forth. In the exposure unit 1 are arranged a polygon mirror for scanning laser beams and optical elements such as a lens and a mirror for directing laser light reflected from the polygon mirror to the photoreceptor drum 3. Alternatively, as the exposure unit 1, it is possible to adopt a construction employing light-emitting elements arranged in an array, for example, EL or LED writing head.

The exposure unit 1 has the function of exposing the photoreceptor drum 3 in a uniformly charged state to light in accordance with inputted image data to thereby form an electrostatic latent image corresponding to the image data on the surface of the photoreceptor drum 3. The developing device 2 develops the electrostatic latent images formed on their respective photoreceptor drums 3 by means of toners of four colors (YMCK). Moreover, the cleaner unit 4 removes and collects residual toner portions remaining on the surface of the photoreceptor drum 3 following the completion of development and image transfer process.

The intermediate transfer belt unit 6 located above the photoreceptor drums 3 comprises an intermediate transfer belt 61, an intermediate transfer belt driving roller 62, an intermediate transfer belt driven roller 63, an intermediate transfer roller 64, and an intermediate transfer belt cleaning unit 65. Four pieces of the intermediate transfer rollers 64 are provided to deal with the colors YMCK on an individual basis.

The intermediate transfer belt driving roller 62, the intermediate transfer belt driven roller 63, and the intermediate transfer rollers 64 support the intermediate transfer belt 61 therearound so as to give tension and allow it to be turnably driven. Moreover, the intermediate transfer rollers 64 impart a transfer bias to transfer the toner image borne on the photoreceptor drum 3 onto the intermediate transfer belt 61.

The intermediate transfer belt 61 is disposed in contact with each of the photoreceptor drums 3. As for the function of the intermediate transfer belt 61, the toner images of different colors formed on the photoreceptor drums 3 are transferred and overlaid one after another onto the intermediate transfer belt 61, whereupon a color toner image (a multi-color toner image) is formed on the intermediate transfer belt 61. For example, the intermediate transfer belt 61 is constructed of a film having a thickness of ca. 100 μm to 150 μm in an endless belt shape.

Transfer of toner images from the photoreceptor drum 3 to the intermediate transfer belt 61 is effected by the intermediate transfer roller 64 kept in contact with the reverse side of the intermediate transfer belt 61. The intermediate transfer roller 64 receives application of a high-voltage transfer bias to achieve toner image transfer (a high voltage of a polarity (+) reverse to the polarity (−) of the charge on the toner). The intermediate transfer roller 64 is a roller constructed of, as a base, a metal (e.g. stainless)-made shaft 8 to 10 mm in diameter, the surface of which is covered with a conductive elastic material (such as EPDM or urethane foam). By virtue of the conductive elastic material, a high voltage can be uniformly impressed on the intermediate transfer belt 61. While, in this embodiment, a roller-shaped component is used as the transfer electrode, a brush-shaped component or the like may be used instead.

As described above, the toner images corresponding to different colors that have been visualized on their respective photoreceptor drums 3 are stacked on top of each other on the intermediate transfer belt 61. The thereby stacked toner images of multiple colors are conveyed as the intermediate transfer belt 61 is turned, and are then transferred onto the recording paper sheet by a transfer roller 10 disposed at a location where the recording paper sheet and the intermediate transfer belt 61 make contact with each other.

At this time, the intermediate transfer belt 61 and the transfer roller 10 are brought into pressure-contact with each other in a predetermined nip portion. Moreover, the transfer roller 10 receives application of a transfer voltage for transferring the toner onto the paper sheet (a high voltage of a polarity (+) reverse to the polarity (−) of the charge on the toner). Further, in order to obtain the nip portion steadily, in constructing the transfer roller 10 and the intermediate transfer belt driving roller 62 disposed face to face with the transfer roller 10, one of them is made of a hard material (metal, etc.) and the other is made of a soft material such as an elastic roller element (elastic rubber roller, resin foam roller, etc.).

Furthermore, the toner that adhered to the intermediate transfer belt 61 upon contact with the photoreceptor drum 3, or the toner that remains on the intermediate transfer belt 61 due to the transfer roller 10 having not effected transfer on the recording paper sheet, is causative of mixing of toner colors in the subsequent process steps. Therefore, in this construction, the adherent/residual toner is removed and collected by the intermediate transfer belt cleaning unit 65.

The intermediate transfer belt cleaning unit 65 is provided with a cleaning blade as, for example, a cleaning member which is brought into contact with the intermediate transfer belt 61. The intermediate transfer belt 61 contacted by the cleaning blade is supported, at its reverse side, by the intermediate transfer belt driven roller 63. As the intermediate transfer belt 61 is turned, the cleaning blade kept in contact therewith scrapes the residual toner off the surface of the intermediate transfer belt 61 and collects it.

The paper feeding cassette 81 is a tray on which are accommodated recording paper sheets for use in image formation. The paper feeding cassette 81 is disposed below the exposure unit 1 of the apparatus main body 110. Moreover, recording paper sheets for use in image formation may be placed on a manual paper-feeding cassette 82, too. The catch tray 91 disposed in the upper part of the apparatus main body 110 is a tray on which printed recording paper sheets are piled up in a face-down manner.

In addition, in the apparatus main body 110 is provided a paper sheet conveyance path S for allowing the recording paper sheets placed on the paper feeding cassette 81 as well as on the manual paper-feeding cassette 82 to be conveyed upwardly in substantially a vertical direction so that they can be directed toward the catch tray 91 by way of the transfer roller 10 and the fixing unit 7. In the vicinity of the paper sheet conveyance path S ranging from the paper feeding cassette 81 as well as the manual paper-feeding cassette 82 to the catch tray 91, there are arranged pick-up rollers 11*a* and 11*b*, a plurality of conveying rollers 12*a* through 12*d*, registration rollers 13, the transfer roller 10, the fixing unit 7, and so forth.

The conveying rollers 12*a* through 12*d* are a plurality of compact rollers arranged along the paper sheet conveyance path S for facilitating and assisting the conveyance of the recording paper sheets. Moreover, the pick-up roller 11*a* is disposed in the vicinity of the end of the paper feeding cassette 81 for picking up the recording paper sheets one by one from the paper feeding cassette 81 and feeding them to the paper sheet conveyance path S. Likewise, the pick-up roller 11*b* is disposed in the vicinity of the end of the manual paper-feeding cassette 82 for picking up the recording paper sheets one by one from the manual paper-feeding cassette 82 and feeding them to the paper sheet conveyance path S.

The registration rollers 13 temporarily hold the recording paper sheet in the process of being conveyed along the paper sheet conveyance path S. In order for the toner image borne on the photoreceptor drum 3 to be transferred to a predetermined location on the recording paper sheet, the registration rollers 13 convey the recording paper sheet in keeping with the rotation of the photoreceptor drum 3.

The fixing unit 7 comprises a heat roller 71 and a pressurizing roller 72. The heat roller 71 and the pressurizing roller 72 are rotated, with the recording paper sheet having a transferred toner image lying therebetween. The heat roller 71 is temperature-controlled by a control section so as to have a predetermined fixing temperature on the basis of a signal issued from a non-illustrated temperature detector. The heat roller 71 has the capability of bonding, in conjunction with the pressurizing roller 72, the toner onto the recording paper sheet under application of heat and pressure, so that the toner images of multiple colors transferred onto the recording paper sheet can be melted, mixed, and brought into pressure-contact with one another and eventually thermally fixed onto the recording paper sheet. In addition, an externally heating belt 73 is disposed to heat the heat roller 71 from outside.

Next, the paper sheet conveyance path will be described in detail. As described above, the image forming apparatus 100 is provided with the paper feeding cassette 81 for storing the recording paper sheets in advance and the manual paper-feeding cassette 82. In order for the recording paper sheets to be supplied from those paper feeding cassettes 81 and 82, the pick-up rollers 11*a* and 11*b* are arranged to direct the sheets one by one to the paper sheet conveyance path S.

The recording paper sheet conveyed from each of the paper feeding cassettes 81 and 82 is conveyed by the conveying rollers 12*a* of the paper sheet conveyance path S to the registration rollers 13, and is further conveyed to a transfer position in a timed relation with the positioning between the recording paper sheet and the toner image borne on the intermediate transfer belt 61, whereupon the toner image is transferred onto the recording paper sheet. After that, as the recording paper sheet passes through the fixing unit 7, the yet-to-be fixed toner is molten and fixed onto the recording paper sheet under application of heat, and eventually the recording paper sheet is discharged, through the conveying rollers 12*b* located posteriorly of the fixing unit 7, onto the catch tray 91.

The paper sheet conveyance path thus far described is adapted for a print-job request for single-sided printing on the recording paper sheet. On the other hand, in order to deal with a print-job request for double-sided printing, after the single-sided printing is completed in the above-described manner and the front end of the sheet that passed through the fixing unit 7 is caught hold of by the conveying rollers 12*b*, the conveying rollers 12*b* are rotated in a reverse direction so as to direct the recording paper sheet to the conveying rollers 12*c* and 12*d* arranged along a path located outside of the fixing unit 7. Then, after the recording paper sheet passes through the registration rollers 13 and the back side thereof is subjected to printing process, the recording paper sheet is discharged onto the catch tray 91.

Figure 2:
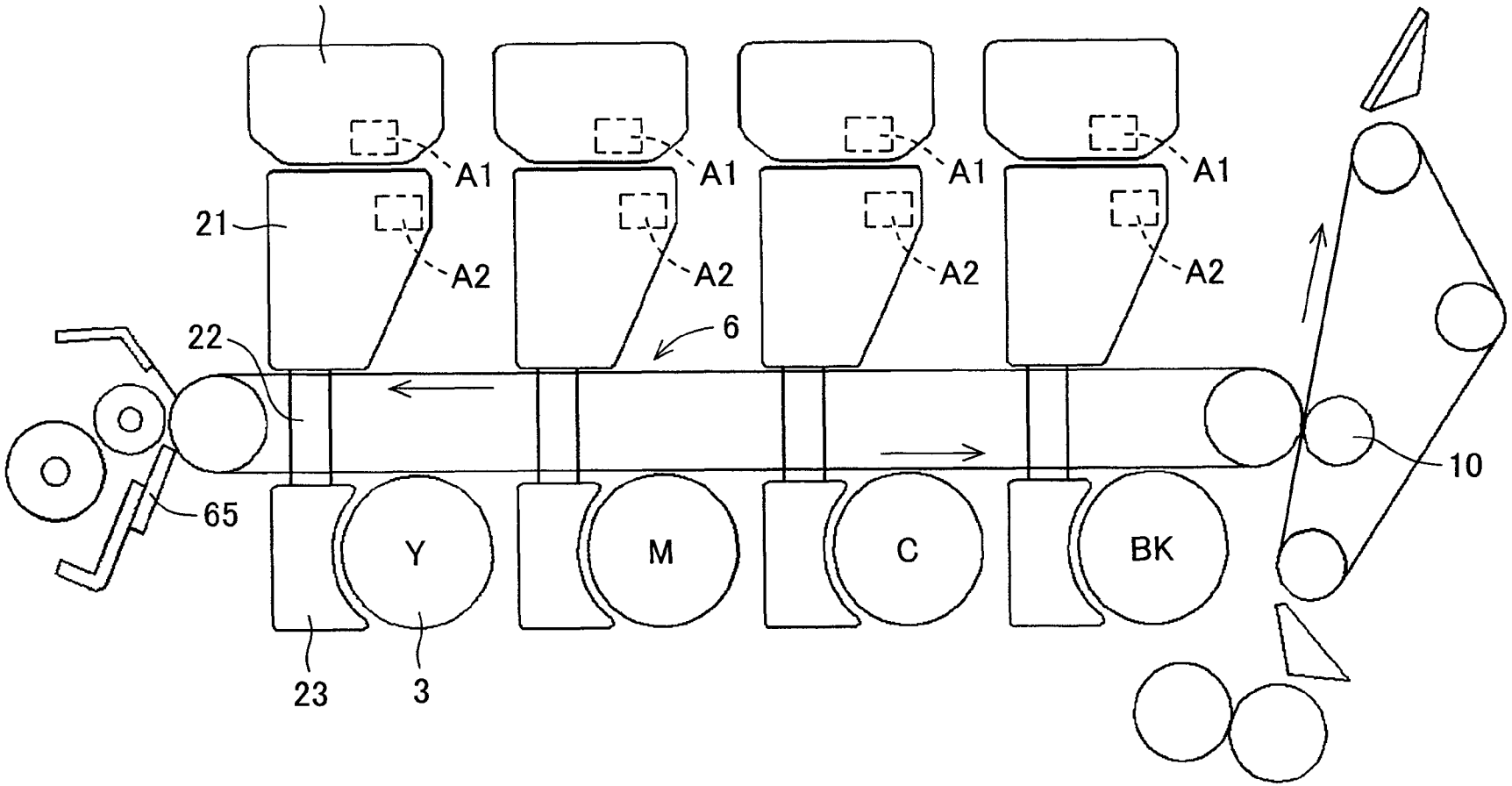
FIG. 2 is a partly enlarged view of an image formation processing section of the image forming apparatus.

FIG. 2 is a partly enlarged view of an image formation processing section of the image forming apparatus 100.

A toner for replenishment is contained in a toner cartridge 20. The toner is supplied to an intermediate hopper 21 on an as needed basis. The toner contained in the intermediate hopper 21 is supplied through a coupling pipe 22 to a developer tank 23 of the developing device 2.

There is no particular limitation to a mechanism for supplying a toner from the toner cartridge 20 to the intermediate hopper 21, as well as to a mechanism for supplying a toner from the intermediate hopper 21 to the developer tank 23. It is thus possible to use an existing supply mechanism therefor.

For example, the toner cartridge 20 is constructed of a bottle-type cartridge. In the bottle-type construction, a spiral rib is formed interiorly thereof. As the cartridge is rotated, the toner contained therein is conveyed along the rib to the end of the cartridge. At the end of the cartridge is formed a replenishing port through which the toner conveyed thereto is dropped down so as to be fed into the intermediate hopper 21. The feeding amount may be controlled in accordance with the number of rotation and the period of time for rotation of the cartridge.

The intermediate hopper 21 is funnel-shaped and is connected to the coupling pipe 22 at its leg. A shutter is disposed in the part of connection between the intermediate hopper 21 and the coupling pipe 22, as well as in the part of connection between the coupling pipe 22 and the developer tank 23. When the shutter is caused to open, the intermediate hopper 21 and the developer tank 23 are brought into communication with each other via the coupling pipe 22, whereupon the toner contained in the intermediate hopper 21 is dropped down so as to be fed into the developer tank 23. The feeding amount can be controlled in accordance with the period of time for the opening of the shutter.

The toner cartridge 20 is provided with a cartridge detection sensor A1 for detecting the remaining amount of the toner contained in the toner cartridge 20. The intermediate hopper 21 is provided with a hopper detection sensor A2 for detecting the remaining amount of the toner contained in the intermediate hopper 21 and detecting whether the intermediate hopper 21 is filled to capacity with the toner or not. Such a toner-cartridge and intermediate-hopper unit including the detection sensors A1 and A2 is provided for each of the colors Y, M, C, and K on an individual basis.

Used as a system for detecting the remaining amount of the toner within the toner cartridge 20, as well as the remaining amount of the toner within the intermediate hopper 21, is a toner end detection sensor composed of a light-emitting element and a light-receiving element that are arranged in such a manner that light is emitted from the light-emitting element in a horizontal direction. In this construction, during the interval in which the toner is contained in an amount greater than or equal to a specified amount, the light-receiving element is unable to receive light, because the toner blocks off light. Then, when the amount of the toner decreases below the specified amount, light is allowed to reach the light-receiving element. By means of the detection sensor thereby constructed, it is possible to detect whether or not the remaining amount of the toner is greater than or equal to the specified amount.

Moreover, the intermediate hopper 21 includes also the sensor for detecting whether it is filled to capacity with the toner or not. For example, whether or not the intermediate hopper 21 is filled to capacity with the toner can be detected in the following manner.

Inside the intermediate hopper 21 is disposed an agitating section, on the rotating shaft of which is mounted a fin. When the fin and the toner are brought into contact with each other, the rotary torque of the rotating shaft is changed. By sensing this change, the presence or absence of a capacity toner can be detected. Alternatively, there is additionally provided a mechanism for causing gear jumping, gear slippage, or the like when a predetermined torque is reached. In this case, by sensing the gear jumping, the gear slippage, or the like, the presence or absence of a capacity toner can be detected.

Moreover, in order to exercise toner replenishment control for the developer tank 23, a magnetic permeability sensor is disposed in the developer tank 23. With the aid of this sensor, the replenishment of the toner is effected in such a manner as to achieve a proper ratio as to the amount of the toner to be fed on the basis of the toner-carrier mixing ratio. In effecting the toner replenishment, the amount of the toner to be fed is so controlled as to keep the toner-carrier mixing ratio constant rather than keeping the weight of the toner constant.

Note that some adjustment, such as oversupply and imposition of replenishing restrictions, may be made to attain an optimum charging amount with respect to a period of time over which the toner is left to stand (the toner is decreased in bulk when left standing for a long period of time), continuous printing at a low coverage rate, continuous printing at a high coverage rate, and the life of carrier.

Figure 3:
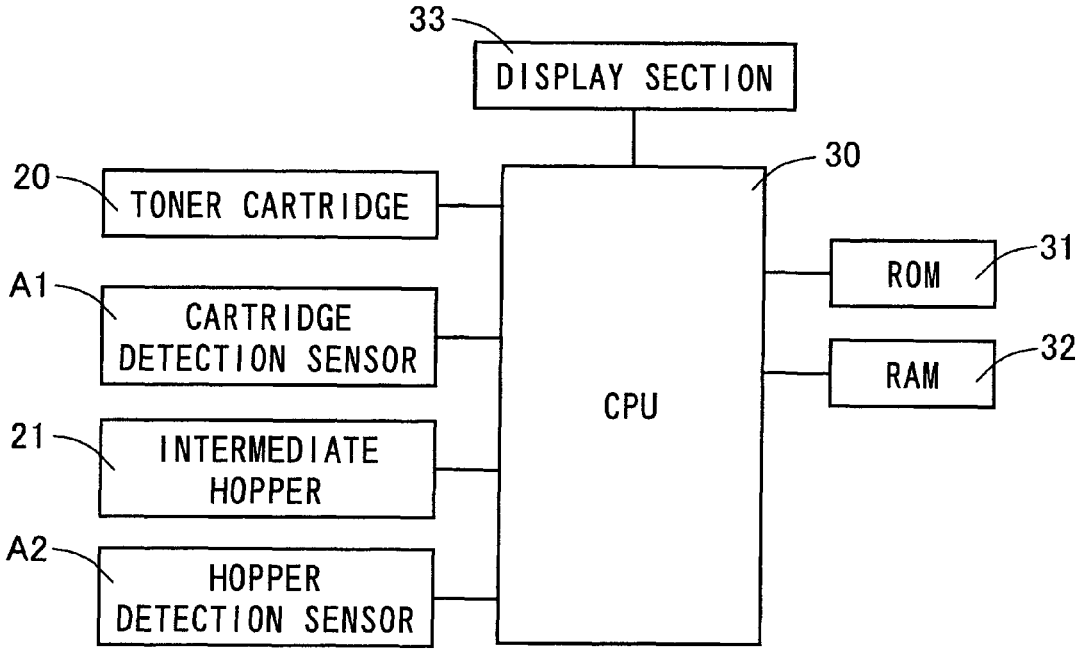
FIG. 3 is a block diagram showing the electrical configuration of a part of the image forming apparatus which is concerned with toner replenishment.

FIG. 3 is a block diagram showing the electrical configuration of a part of the image forming apparatus 100 which is concerned with toner replenishment.

A CPU 30 performs operation for control over the image forming apparatus 100 as a whole, including toner replenishment control. A ROM (Read Only Memory) 31 stores therein a toner replenishment program for getting the toner cartridge 20, the intermediate hopper 21, and so forth to work to effect toner replenishment, a cartridge replacement program for making a judgment as to the time for the replacement of the toner cartridge 20, for producing a display of a request for replacement, and so forth, an image formation program for conducting image forming operation, and so forth. A RAM (Random Access Memory) 32 stores temporarily therein data necessary to carry out operation in accordance with each of the programs. A display section 33, which is disposed for example in an operation panel of the image forming apparatus 100, provides a display of an operation menu and gives notices about a request for toner cartridge replacement, occurrence of paper jamming, and so forth.

The above-described detection sensors A1 and A2 provide output of the result of detection to the CPU 30. The CPU 30, after it determines that the intermediate hopper 21 and the developer tank 23 are in need of toner replenishment on the basis of the result of detection, effects control of the toner cartridge 20 and the intermediate hopper 21 in a manner so as to supply the toner. When the toner cartridge 20 is found to be emptied (the toner amount decreases below the specified remaining amount) with the result of the supply of the toner, in order to make the user aware of the necessity of replacement of the toner cartridge 20, a message of request for replacement of the toner cartridge 20 is displayed on the display section 33.

Figure 4:
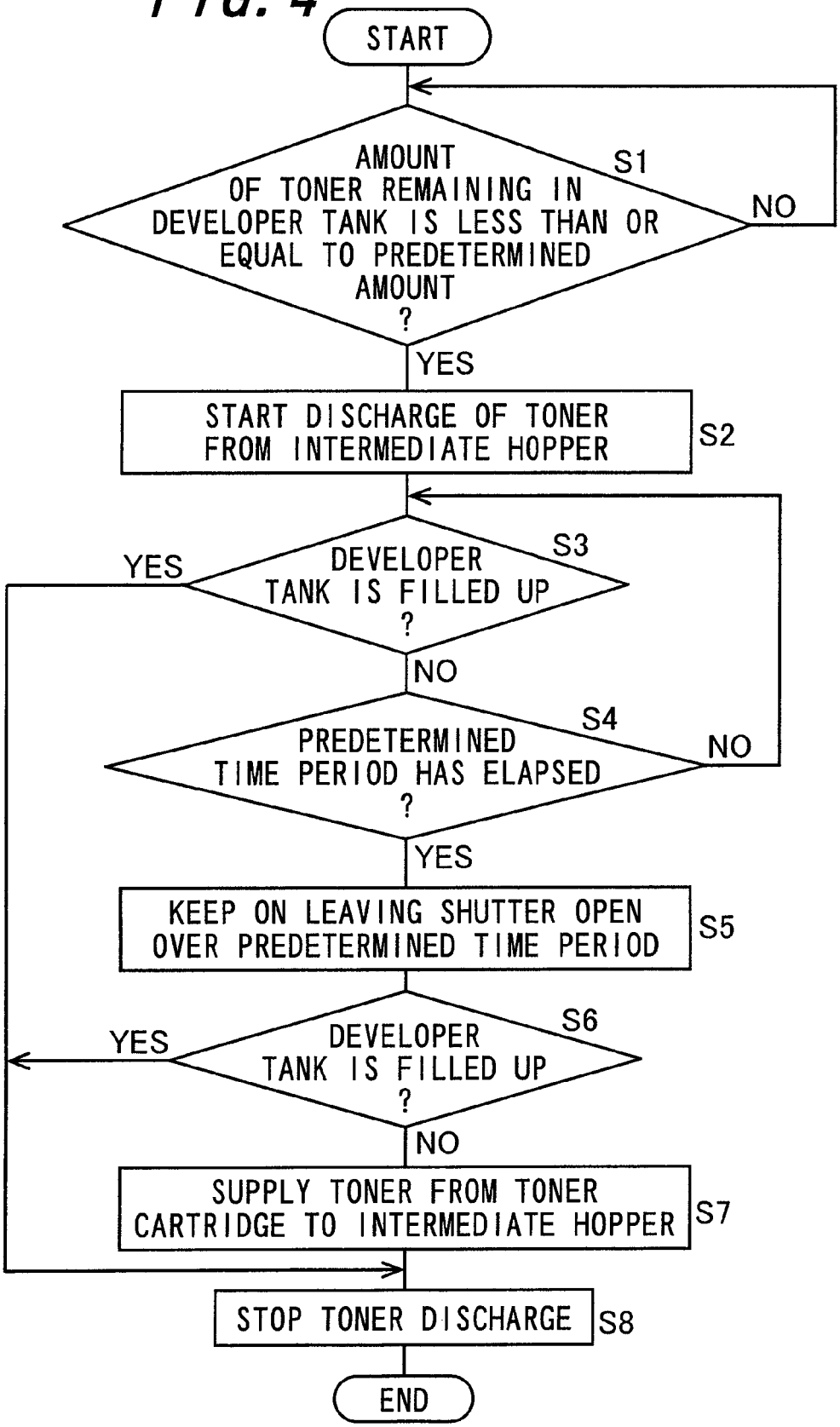
FIG. 4 is a flowchart showing a toner replenishment procedure.

FIG. 4 is a flowchart showing a toner replenishment procedure. In Step S1, whether or not the amount of the toner remaining in the developer tank 23 has been decreased to a predetermined remaining amount or below is determined. When it is determined that the toner amount is less than or equal to the predetermined remaining amount, since replenishment is necessary, the procedure proceeds to Step S2. When it is determined that the toner amount is greater than the predetermined remaining amount, since replenishment is unnecessary, a standby state is established. In Step S2, the shutter of the coupling pipe 22 is opened to start the discharge of the toner from the intermediate hopper 21 into the developer tank 23.

In Step S3, whether or not the developer tank 23 is filled to capacity with the toner (whether or not the toner amount is greater than or equal to a specified amount) is determined. When it is determined that the developer tank 23 is filled to capacity with the toner, the procedure proceeds to Step S8 where the shutter is closed to stop the discharge of the toner. When it is determined that the developer tank 23 is not filled to capacity with the toner, the procedure proceeds to Step S4 where whether or not a specified period of time has elapsed since the opening of the shutter is determined. When it is determined that the specified period of time has elapsed, the procedure proceeds to Step S5 where the shutter is left opened over a predetermined period of time. When it is determined that the specified period of time has not elapsed, the procedure returns to Step S3.

In Step S6, whether or not the developer tank 23 is filled to capacity with the toner (whether or not the toner amount is greater than or equal to a specified amount) is determined. When it is determined that the developer tank 23 is filled to capacity with the toner, the procedure proceeds to Step S8 where the shutter is closed to stop the discharge of the toner. When it is determined that the developer tank 23 is not filled to capacity with the toner, the procedure proceeds to Step S7 where the toner is supplied from the toner cartridge 20 to the intermediate hopper 21. In a case where the developer tank 23 is not filled to capacity with the toner even after long-time opening of the shutter, it is highly likely that the amount of the toner remaining in the intermediate hopper 21 is small or that the intermediate hopper 21 is empty. Therefore, the toner is supplied from the toner cartridge 20 to the intermediate hopper 21.

As toner replenishment is taking place in that way, the amount of the toner remaining in the toner cartridge 20 is decreased, and when the toner cartridge 20 is eventually emptied, it is in need of replacement.

Figure 5:
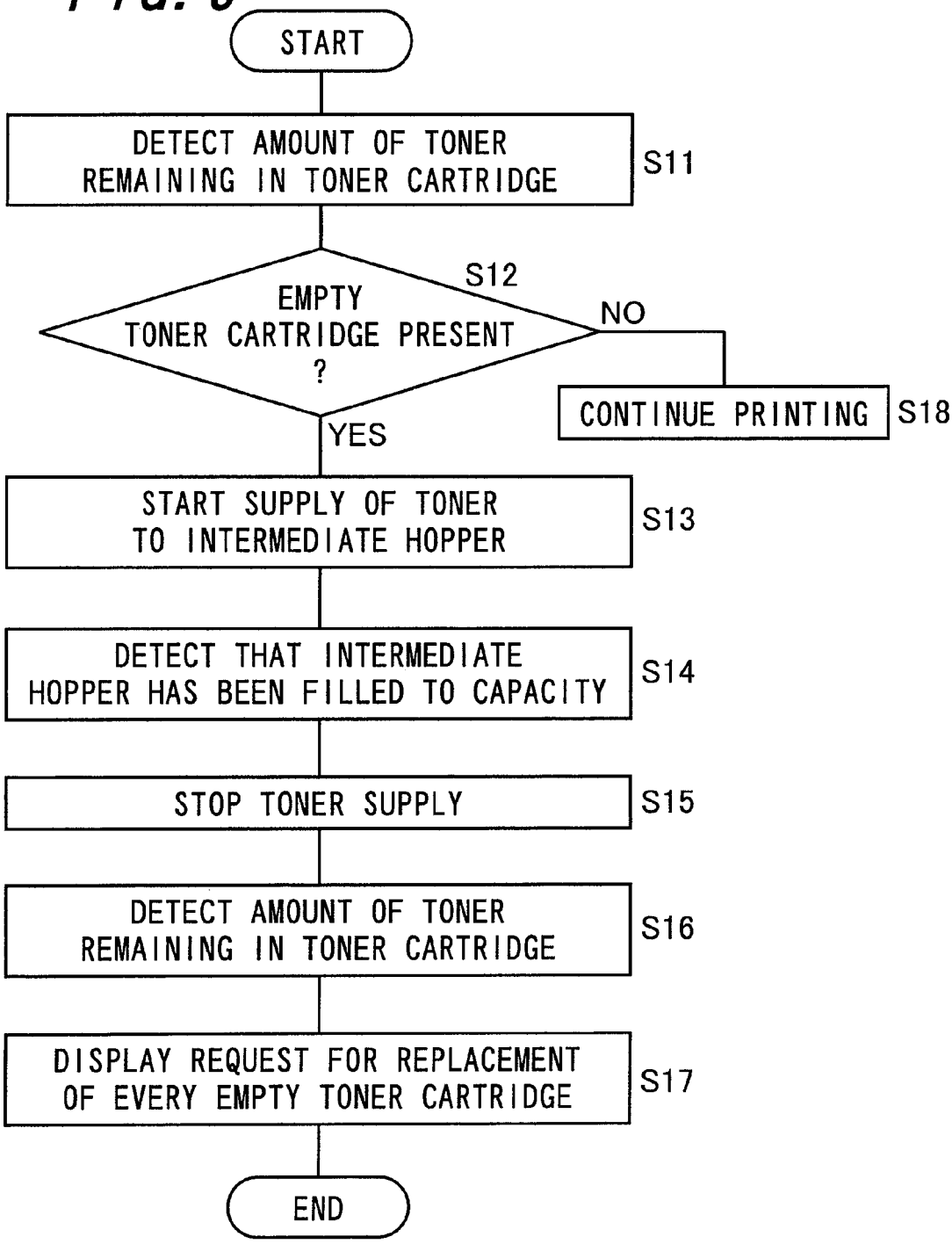
FIG. 5 is a flowchart showing a procedure of for replacement of a toner cartridge.

FIG. 5 is a flowchart showing the procedure for replacement of the toner cartridge 20. In Step S11, all of the toner cartridges 20 are subjected to detection on an individual basis in respect of the remaining amount of the toner contained therein. The CPU 30 detects the remaining amount of the toner by means of the remaining amount detection sensor A1 at specified different times, namely during printing, when the power is turned on, and when printing operation is started or completed. In Step S12, the presence or absence of the toner cartridge 20 in an empty state, even only one, is determined. When it is determined that even a single one of the toner cartridges 20 is empty, the procedure proceeds to Step S13. When it is determined that none of the toner cartridges 20 is empty, the procedure proceeds to Step S18 where the printing operation is further continued.

In Step S13, the toner contained in another toner cartridge 20 than the toner cartridge 20 in an empty state is forcibly discharged so as to be fed into the intermediate hopper 21. In Step S14, the supply of the toner from another toner cartridge 20 is continued until the intermediate hopper 21 is filled to capacity. In Step S15, the supply of the toner from another toner cartridge 20 is stopped.

By detecting the amount of the toner in the intermediate hopper 21, the amount of the toner that is forcibly supplied from another toner cartridge to the intermediate hopper 21 can be so controlled as to be an adequate amount. In particular, by continuing the supply of the toner from another toner cartridge 20 until the intermediate hopper 21 is filled to capacity, it is possible to take the maximum amount of the toner forcibly out of another toner cartridge 20.

In Step S16, another toner cartridge 20 is subjected to detection in respect of the remaining amount of the toner contained therein. In Step S17, a message of request for toner cartridge replacement is displayed on the display section 33 in order for all of the toner cartridges 20 determined to be empty to be replaced with the new ones. Moreover, in a case where printing is under way, the printing operation is brought to a halt.

In a case where an empty toner cartridge 20 has been newly found among another toner cartridges 20, a request for replacement of the toner cartridge 20 previously determined to be empty and the toner cartridge 20 newly determined to be empty is issued. In a case where no empty toner cartridge 20 has been newly found among another toner cartridges 20, a request for replacement of only the toner cartridge 20 previously determined to be empty is issued.

Following the completion of the replacement of the toner cartridge 20 by the user on the replacement request, the printing operation is resumed after a halt.

In the presence of a plurality of the toner cartridges 20 that differ little from one another in the amount of the contained toner, even if there is a toner cartridge 20 in which the toner amount has not yet been reduced to a level where replacement is required, when a specified amount of the toner contained therein is forcibly supplied to the intermediate hopper 21 to reduce the toner amount, its replacement may be necessary.

After the amount of the toner is forcibly reduced, toner amount detection is conducted once again. In this way, a toner cartridge in need of replacement can be newly detected, and a request for replacement of all of the toner cartridges in need of replacement can be displayed on the display section 33.

This makes it possible for the user to replace a plurality of toner cartridges en masse in a single replacement procedure, wherefore the work burdens imposed on the user can be reduced.

Note that the printing operation may be continued without interruption until the remaining amount of the toner in the developer tank 23 or the remaining amount of the toner in the intermediate hopper 21 is decreased to the specified remaining amount or below.

Moreover, even if an empty toner cartridge 20 is detected in the course of printing operation, so long as there is a toner cartridge 20 which is not emptied, the printing operation is continued without interruption. This makes it possible to reduce the number of times that the operation is brought to a halt during printing.

Since there may be cases where a plurality of toner cartridges are provided for the black toner, it is possible to reduce the number of times that the printing operation is brought to a halt. Moreover, even if color-toner shortages occur, black-and-white printing can be effected. For example, even if an empty toner cartridge 20 is detected, so long as there is a toner cartridge 20 which is not emptied, by performing printing without using toners of all colors, such as two-color printing and three-color printing, or by performing black-color printing with use of a mixture of three colors, it is possible to continue printing operation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a plurality of toner cartridges for containing toners for replenishment on a color-by-color basis;

a plurality of intermediate hoppers to which the respective toners contained in the plurality of toner cartridges are to be supplied;

a plurality of developing devices to which the respective toners supplied to the respective intermediate hoppers are to be supplied;

toner amount detection sections for detecting amounts of the toners contained in the plurality of toner cartridges, respectively; and a control section for exercising control in such a manner that, when at least one of detected amounts of the toners contained in a first one of the plurality of toner cartridges by the toner amount detection sections is less than a specified amount, then a specified amount of toner is supplied from another toner cartridge different from the first toner cartridge to the intermediate hopper corresponding to the another toner cartridge.

2. The image forming apparatus of claim 1, further comprising a display section for indicating a request for replacement of the toner cartridge, wherein the toner amount detection section detects the amount of the toner within the another toner cartridge after the specified amount of the toner is supplied from the another toner cartridge to the corresponding intermediate hopper, and the control section effects control of the display section in a manner so as to indicate a request for replacement with respect to every one of the toner cartridges in which the amount of the toner contained therein is found to be less than the specified amount through the detection made by the toner amount detection section.

3. The image forming apparatus of claim 1, further comprising a hopper toner amount detection section for detecting the amount of the toner within the plurality of intermediate hoppers, wherein the control section exercises control in such a manner that the supply of the toner from the another toner cartridge to the corresponding intermediate hopper is continued until the hopper toner amount detection section detects that the amount of the toner within the corresponding intermediate hopper is greater than or equal to a specified amount.

4. The image forming apparatus of claim 3, wherein the hopper toner amount detection section detects whether the corresponding intermediate hopper is filled to capacity with the toner or not, and the control section exercises control in such a manner that the supply of the toner from the another toner cartridge to the corresponding intermediate hopper is continued until the hopper toner amount detection section detects that the corresponding intermediate hopper is filled to capacity with the toner.

5. The image forming apparatus of claim 1, wherein, in a course of image forming operation, even if the toner amount detection section detects that at least one of a plurality of the toner cartridges is in a state where the amount of the toner contained therein is less than a specified amount, so long as it can be detected by the toner amount detection section that at least one of a plurality of the toner cartridges is in a state where the amount of the toner contained therein is greater than or equal to the specified amount, the control section continues the image forming operation.

* * * * *